United States Patent [19]

Cross

[11] 4,351,123

[45] Sep. 28, 1982

[54] DISPLAY MOUNT AND METHOD

[76] Inventor: Carroll N. Cross, Rte. 2, Box 741, Maitland, Fla. 32751

[21] Appl. No.: 227,425

[22] Filed: Jan. 22, 1981

[51] Int. Cl.[3] ..... G09D 3/04

[52] U.S. Cl. ..... 40/120; 40/152.1

[58] Field of Search ..... 40/120, 152.1, 159, 40/16, 10 D

[56] References Cited

U.S. PATENT DOCUMENTS

| | | | |
|---|---|---|---|
| 3,032,904 | 5/1962 | Washburn | 40/122 |
| 3,117,757 | 1/1964 | Sampson | 248/455 |
| 3,210,874 | 10/1965 | Nichols | 40/120 |

*Primary Examiner*—Gene Mancene
*Assistant Examiner*—Wenceslao J. Contreras
*Attorney, Agent, or Firm*—William M. Hobby, III

[57] ABSTRACT

A display mount apparatus has a plurality of casebound panels connected together to define a hinged line between each pair of hinged panels. A transparent polymer material overlays the casebinding material covering at least a portion of two panels and extending over the hinged area to form at least two transparent pockets so that display material can be mounted in each pocket and the bending of the panels relative to each other will hold the display material in the polymer pocket. A method of making a display mount is provided having the steps of connecting a plurality of panels together and then casebinding the panels on at least one side. A transparent pocket is attached over a portion of the casebound panels and display material is inserted into the transparent pockets. Die cutting the panels die cuts the polymer pockets and display material to form a plurality of display mounts.

12 Claims, 6 Drawing Figures

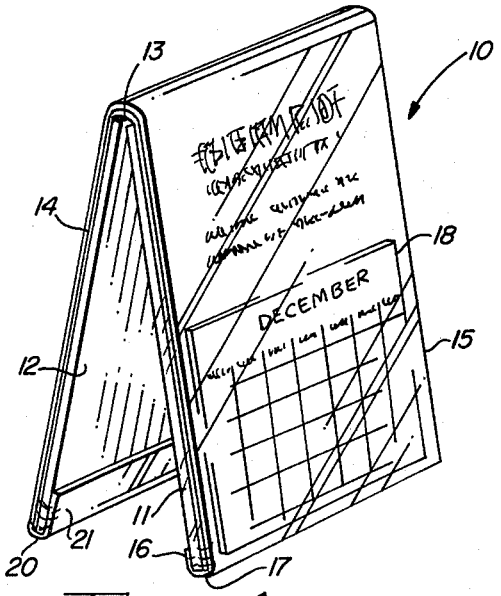
FIG. 1
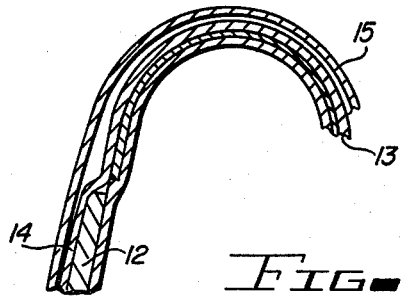
FIG. 2
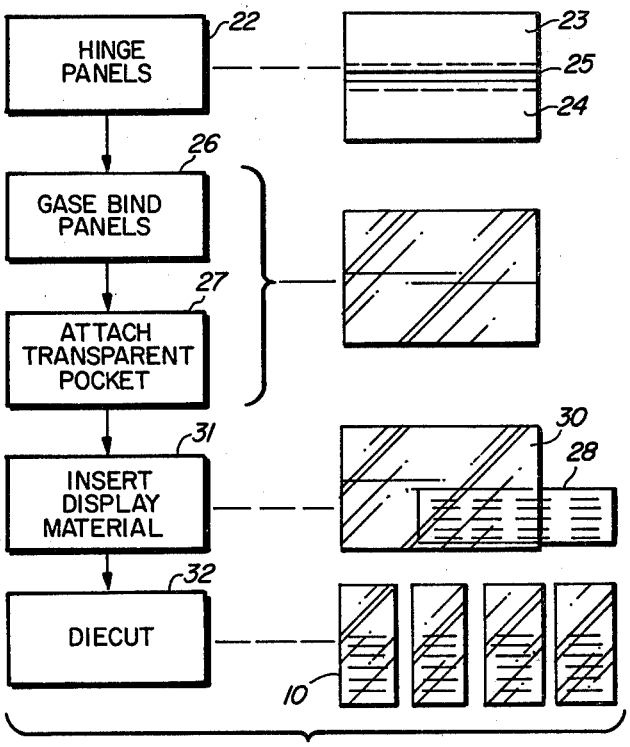
FIG. 3
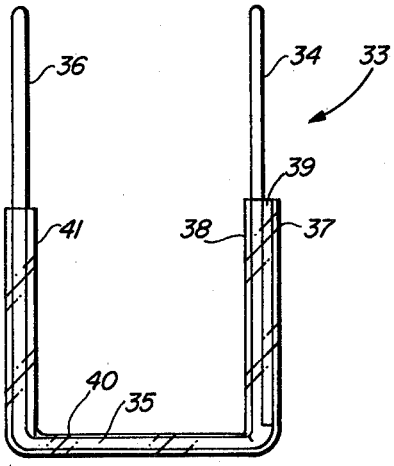
FIG. 4
FIG. 6
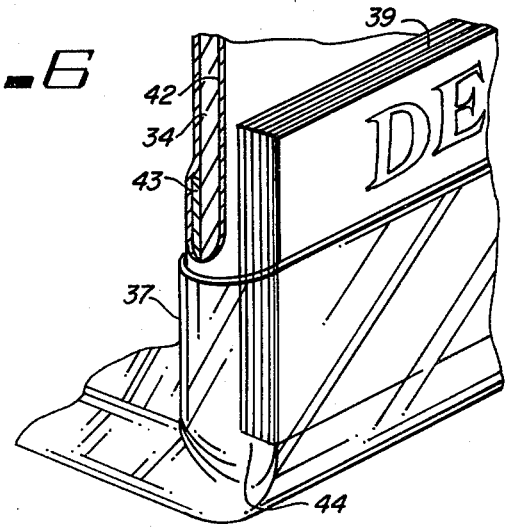
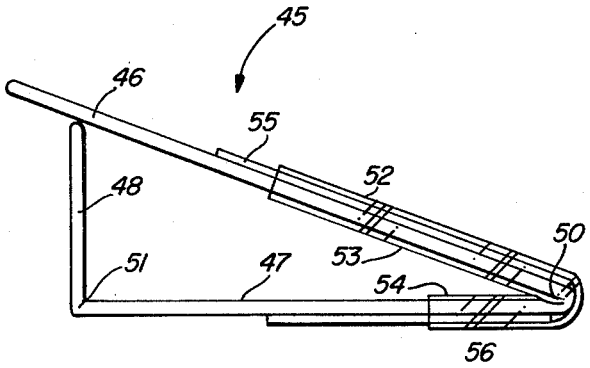
FIG. 5

DISPLAY MOUNT AND METHOD

BACKGROUND OF THE INVENTION

The present invention relates to a display mount and a method of making a display mount having transparent film pockets formed thereon. This invention is an improvement over the invention in my prior patent application, Ser. No. 145,775, for Display Mount and Method, filed May 2, 1980.

In the past, a great variety of displays for displaying calendars and the like have been provided. Typically, these display mounts are made of cardboard which have a plurality of calendar leaves attached by staples, stitches, or placed in cutout pockets on the display mount. The display may be provided with some means for supporting the display, such as having a rear hinged panel and a tongue connecting one panel to the other to hold the panels in position. The present invention is directed toward a display mount having a transparent pocket so that insertions such as calendar pads or photographs can be viewed through the pocket or to hold most of the leaves of a calendar pad with the top pages on top of the pocket.

Until this invention, the advantages of transparent pockets on the outside of two front panels of a mount with bookbound edges and the method of making it economically has not been available.

This invention includes a transparent material mounted to extend over the hinged area of hinged panels to form at least two pockets which are held in place by the folding of the panels which tightens the transparent material onto display materials to prevent dislodgment and may also form a supporting edge.

Typical display mounts for calendar pads and the like may be seen in my prior U.S. Pat. No. 2,355,706, for a display mount having an aluminum hinge for displaying materials such as calendar pads; and in the U.S. Pat. Nos. 3,058,410 and 3,079,751, for an improved display mount structure and improved method for forming the display windows and display wells in display mount structures. In addition, may prior patents on display and photomounts may be seen in U.S. Pat. Nos. 3,216,582, 3,068,139, and 3,002,720, which include my patent on an aluminum hinge which allows a supporting prop or other display mount supports to be mounted with a flexible hinged panel which stays in place without the use of interconnecting tongues or the like.

The present invention advantageously provides a transparent pocket for the placement of calendar pads, or the like, along with the method of making display mounts with transparent pockets formed thereon which preferably reduces the weight of the display mount by the use of single panels in the forming of the display mounts. The display mounts also provide an attractive appearance, compactness and reduce the costs of producing the mounts, as well as the costs for postage when mailed. Increased strength and stability of the mount results by not using cutout panels for the calendar pad leaves which are retainable inside the pocket without staples. The transparent pocket mounted over a hinged area enables two pockets to be formed at one time and a convenient method of tightening the pocket onto the displayed material to prevent dislodgment of the material from the pocket.

SUMMARY OF THE INVENTION

The present invention relates to a display mount apparatus and method of making a display mount. The display mount has a plurality of casebound panels connected together to define at least one hinged area. A transparent polymer material overlays the casebinding material of at least a portion of two panels and extending over a hinged area to form at least two transparent pockets so that the display material mounted in a pocket is held in place by bending one panel relative to the second on the hinged area having the polymer material extending thereover.

A method of making a display mount includes the step of connecting a plurality of panels together, casebinding the plurality of panels on at least one side, and attaching a transparent pocket over a portion of the casebound panel. Display material may then be inserted into the transparent pocket. The panel's display material and transparent pockets are die cut into a plurality of display mounts, each having a transparent pocket with a separate display material already mounted therein.

BRIEF DESCRIPTION OF THE DRAWINGS

Other objects, features and advantages of the present invention will be apparent from the written description and the drawings in which:

FIG. 1 is a perspective view of a display mount in accordance with a preferred embodiment of the present invention.

FIG. 2 is a sectional view of the hinged area of the display mount of FIG. 1.

FIG. 3 is a flow diagram of the method of making a display mount in accordance with the present invention.

FIG. 4 is an end elevational view of a second embodiment of a display mount in accordance with the present invention.

FIG. 5 is an end elevation of a third embodiment of a display mount in accordance with the present invention.

FIG. 6 is a breakaway perspective view of the hinged area of a display mount in accordance with this invention.

DESCRIPTION OF THE PREFERRED EMBODIMENTS

Referring to the drawings and especially to FIGS. 1 and 2, a display mount 10 is illustrated having a pair of panels 11 and 12 hinged together with a thin strip of ductile material, such as aluminum 13. The panels 11 and 12 are casebound with a binding material 14 which may cover both panels over the front of each panel and over the aluminum hinge 13. The backside of the panels 11 and 12 may be covered with paper and may have the front binding rolled over the edges of the panel 11 and 12 with the edges attached to the backside thereof. A transparent polymer material 15 has been attached over the casebinding 14 starting with the back edge 16 extending around the bottom edge of the front panel 17 over a calendar pad 18, or the like, over the hinged area 13, over the face of the back panel, around the bottom edge 20 of the rear panel 12, and having its edge 21 attached to the back of the back panel 12. Attached in this manner, in accordance with the process illustrated in FIG. 3, display material such as calendar pads, photographs, or the like, can be displayed on both sides of the display mount 10. The display mounts 10 are manufactured in a flat plane and are folded and held in position by the aluminum hinge as shown in FIG. 10. Advantageously, the transparent polymer covering material can be loosened by folding the display mount 10 into a generally flat plane to allow display material to be slipped under the polymer covering pockets and when folded into the position shown in FIG. 1. The covering polymer 15 is pulled taut locking the calendar pad, photograph, or other display material in position. That is, folding the panels in one direction on hinge 13 will loosen the covering transparent pocket while folding it to its set-up position, pulls the material taut to lock the display material in place.

FIG. 2 illustrates the hinged area having its transparent polymer in its folded, taut position with arrows indicating the folding direction to loosen the plastic covering. In addition, having the transparent polymer material extend over both panels with each of the opposite edges of the polymer sealed to the back or opposite edges of the panels provides an attractive appearance without a visible attaching means, such as heat sealing or stapling, appearing on the face panels.

Turning now to FIG. 3, a flow diagram of a process for manufacturing the display mount in accordance with FIG. 1 is illustrated. The first step 22 is hinging a pair of panels 23 and 24 together with an aluminum hinge 25. The hinged panels are then casebound 26 and a transparent polymer covering 27 attached over the casebinding but not attached to the casebinding of the panel faces. A row of calendars or other display material 28 may be slid under the polymer covering 30 over the panel 24, as shown in Step 31, and the combined panels 23 and 24 which are hinged, casebound and covered with a transparent polymer material is die cut 32 into a plurality of individual display mounts 10, each already having a calendar pad or other display material therein. Display panels 10 may be shipped in a flat plane as shown and folded into a set-up position as shown in FIG. 1. Folding to a set-up position brings the transparent polymer covering material or pockets into a greater tautness for locking the calendar pads into position. Photographs may be inserted by the purchaser in both front and rear pockets after the display is completed.

Turning now to FIGS. 4 and 6, an alternate embodiment of the display mount 33 is illustrated having three panels 34, 35 and 36. Panel 34 and 35 are hinged together along one of their edges, while panels 35 and 36 are hinged together along one of their edges, so that when the panels 34 and 35 are folded into an upright position relative to panel 35, a display and letter holder is formed. In this embodiment, the transparent polymer covering material 37 is usually mounted transverse to the display and wrapped around the side edges of panels 34, 35 and 36 and attached to panel 34 along the rear edge 38 thereof, and to panel 35 along the top edge 40 thereof and to the rear edge 41 of panel 36. A calendar pad 39 is shown mounted in one pocket. This display, advantageously, allows display pockets to be located on both sides of the display and is loosened or pulled taut by folding the display mount flat or into its upright display position, as shown in FIG. 4. Each panel is casebound as shown in FIG. 6, by casebinding 42 on the panel 34, which may extend over the outside of panels 34, 35 and 36. The aluminum hinge material 43 may be seen in this view, along with a better view of the polymer covering material 37 extending around the hinged area 44.

FIG. 5 illustrates yet another embodiment in which a display mount 45 has a face panel 46, a base panel 47 and an upright support panel 48, which may all be casebound with the face panel 46 hinged to the base panel 47 at the hinge area 50 and the base panel 47 hinged to the support panel 48 at a hinge area 51 with an aluminum hinge. Transparent polymer covering material 52 is mounted in a transverse direction over the hinged area 50 and is attached by an adhesive or by heat sealing on the back portion 53 of panel 46 and on the back portion 54 of the base panel 47. A calendar pad or other display material 55 can be held in the pockets formed by the transparent polymer material 52, while a spare or alternate display material 56 can be inserted in the pocket formed along the bottom of the base panel 47. For instance, a calendar pad might be inserted in the pocket formed on the face of face panel 46, while the next year's calendar 56 might be held in reserve in the pocket formed on the base panel 47.

This display mount, in accordance with this invention, is an inexpensive support which allows a plurality of pockets to be formed simultaneously and inexpensively manufactured as illustrated in the process and holds display material in transparent polymer pockets on both sides of the display mount with means at the hinge for holding display material against it being dislodged. However, the present invention is not to be construed as limited to the particular forms shown, which are to be considered illustrative rather than restrictive.

I claim:

1. A display mount comprising in combination:

a plurality of casebound panels connected together along at least one edge of each panel to define at least one hinged area;

a transparent polymer material overlaying said casebinding material of at least a portion of two panels and extending over said hinged area to form at least two transparent pockets, whereby display material mounted in a pocket is held in place by bending one panel relative to a second on said hinged area having said polymer material extending thereover.

2. A display mount in accordance with claim 1, in which said plurality of casebound panels is two panels connected together along one edge with a ductile aluminum strip.

3. A display mount in accordance with claim 1, in which said transparent polymer material overlays the entire face of both panels and extends over one edge of each panel and is connected to the back side thereof.

4. A display mount in accordance with claim 2, in which said transparent polymer material overlays said casebinding material on the face of said panels and has two edges secured along to two edges to the binding material folded over one edge of each panel and attached to the rear side thereof.

5. A display mount in accordance with claim 1, in which said transparent polymer material overlaying said casebinding material is fastened to the casebinding material along the back side of two panels across the back of the hinged area at either end of the hinged area.

6. A method of making display mount comprising the steps of:

connecting a plurality of panels together;

casebinding said plurality of panels on at least one side;

attaching a transparent pocket over at least a portion of said casebounding panels;

inserting display material comprising one or more pages or sheets of display material into said transparent pocket;

die cutting said panels and display material therein into a plurality of display mounts, each having a transparent pocket with separate display material therein.

7. A method of making display mounts in accordance with claim 6, in which the step of inserting display material includes inserting a series of identical calendars printed on elongated sheets of paper, whereby die cutting said panels and display material will leave one calendar in each display mount.

8. A method of making display mounts in accordance with claim 6, in which the step of connecting a plurality of panels together includes connecting the panels together with a strip of thin aluminum adhesively attached to each panel along one edge of each panel.

9. A method of making display mounts in accordance with claim 6, in which the step of attaching a transparent pocket over at least a portion of the casebound panels includes attaching transparent material to the casebinding material and attaching the casebinding material around the edge of the plurality of panels and to the back side of the panels, thereby attaching the casebinding and transparent pocket to the display mount simultaneously.

10. A method of making display mounts in accordance with claim 6, in which the step of attaching a transparent pocket over at least a portion of said casebound panels includes attaching said transparent pocket over the hinged portion of said plurality of connected panels.

11. A method of making display mounts in accordance with claim 10, in which the step of attaching a transparent pocket over at least a portion of said casebound panels includes covering the face of said casebound panels and hinged area with a transparent polymer material and attaching said polymer material along the one rear edge of each panel.

12. A display mount in accordance with claim 1, in which said plurality of casebound panels includes first, second and third panels, the first panel having one edge thereof attached with a binding material along one edge of the second panel and the third panel having one edge thereof attached with a strip of thin ductile material along one edge of the second panel.

* * * * *